US008047671B2

(12) United States Patent
Fan et al.

(10) Patent No.: US 8,047,671 B2
(45) Date of Patent: Nov. 1, 2011

(54) CLAMP WITH LAMP

(75) Inventors: YePing Fan, Shanghai (CN); Yong Wu, Shanghai (CN)

(73) Assignee: Shanghai Greatway Electric & Tools, Ltd., Shanghai (CN)

( * ) Notice: Subject to any disclaimer, the term of this patent is extended or adjusted under 35 U.S.C. 154(b) by 234 days.

(21) Appl. No.: 12/507,056

(22) Filed: Jul. 21, 2009

(65) Prior Publication Data

US 2011/0019392 A1 Jan. 27, 2011

(51) Int. Cl.
*B25B 23/18* (2006.01)

(52) U.S. Cl. ..... 362/119; 362/120; 362/253; 439/504; 439/829

(58) Field of Classification Search ..... 362/119, 362/120, 253; 439/188, 489, 490, 504, 829
See application file for complete search history.

(56) References Cited

U.S. PATENT DOCUMENTS 6,638,101 B1 * 10/2003 Botelho ..... 439/504
6,896,544 B1 * 5/2005 Kuelbs et al. ..... 439/504
7,683,629 B2 * 3/2010 Kurtz ..... 324/543

* cited by examiner

*Primary Examiner* — John A Ward
(74) *Attorney, Agent, or Firm* — Levenfeld Pearlstein, LLC

(57) ABSTRACT

A clamp with lamp, particularly useful for attaching to an automobile battery, or similar rechargeable battery, when charging or otherwise working with the battery, is disclosed. The clamp with lamp is configured to provide a convenient source of light during nighttime or other low-light conditions and to provide an automated means for turning the light on and off during use. The clamp with lamp includes an LED lamp disposed on the upper jaw of the clamp, a battery disposed in a battery case inside the handle and a switching mechanism. A switching mechanism is actuated when the jaws of the clamp open, thereby providing power to the LED lamp. When the clamp is engaged with the automobile battery, and when the jaws are closed, the switching mechanism turns off the LED lamp to save electricity. The clamp is small, handy, elegant, and durable.

16 Claims, 2 Drawing Sheets

CLAMP WITH LAMP

BACKGROUND OF THE INVENTION

The present invention is directed to a clamp with lamp, particularly useful for attaching to an automobile battery, or similar rechargeable batteries, when charging or otherwise working with the battery. The clamp with lamp is configured to provide a convenient source of light during nighttime or other low-light conditions and to provide an automated means for turning the light on and off during use of the clamp.

FIG. 1 illustrates a prior art clamp with lamp 101' as is available in the present market. An LED lamp (LBD) 102' is set on the head of the clamp 101', and the lamp 102' is connected in series with a battery and a switch 103'. Such clamps are used in the industry, for example, as part of jumper cables or other cables to connect an automobile battery, or other rechargeable battery, to a charger or other device.

This type of prior art clamp with lamp has several drawbacks. First, the distance between the clamp 101' and the battery and the switch 103' is very long, as is the length of the clamp 101' itself. Additionally, because the clamp 101' is connected to the battery through a long wire, it adds weight and bulk to the device and also makes the device much more vulnerable to damage.

Moreover, the operation of the prior art clamp with lamp 101' is cumbersome and inconvenient. Because the clamp 101' has a non-integrated, manual switch 103', and there is a rather long distance between the switch 103' and the clamp 101', when using clamp 101' at night a user must first turn on the switch 103' to illuminate the LED 102', then connect the clamp 101' to the automobile battery (or other rechargeable battery), and finally switch off the LED lamp 102'.

BRIEF SUMMARY OF THE INVENTION

The purpose of the present invention is to provide a clamp with lamp particularly useful for attaching to an automobile battery, or other rechargeable battery, when charging or otherwise working with the battery. With all the operative elements set in the clamp itself, the clamp with lamp of the present invention is small, easy to operate and electricity-saving as compared to prior art clamps.

To achieve this purpose, the clamp with lamp of the present invention comprises two body members (or clips), an upper clip and a lower clip, each having a jaw end and a handle end. The upper clip and lower clip are pivotally engaged by an axis. The jaw ends of the upper and lower clips may be biased in a closed position (and the handles of the upper and lower clips biased in an open position) using a spring or other means as known in the art.

An LED lamp is disposed at the head of the upper clip (above the jaw end of the upper clip) and a battery is disposed in the handle end of the upper clip. The battery is connected with the LED lamp through an electric circuit controlled by a switching mechanism.

The switching mechanism is disposed at the axis of the clamp and comprises a contact switch disposed in the upper clip and a switch device disposed in the lower clip.

In the disclosed embodiment of the present invention, the contact switch is connected in series between the negative (anode) side of the battery and the negative (anode) side of the LED lamp, and the positive side of the LED lamp is connected with the positive (cathode) side of the battery. Thus, a simple switched electric circuit is formed to control operation of the LED lamp.

In the disclosed embodiment of the present invention, a lampshade, or LED cover, is disposed about the LED lamp and a battery cover, or access panel, is disposed in the upper clip to provide access to the battery compartment and the battery.

The clamp with lamp of the present invention is operated as follows. First, the handle ends of the upper clip and the lower clip are pressed, or squeezed, together, causing the upper clip and lower clip to pivot about the axis and forcing the jaw ends of the upper clip and lower clip open. As the jaw ends of the upper clip and lower clip separate from one another, the switch device in the lower clip rotates around the axis of the clamp, disengaging the switch device from the contact switch, and causing the contact switch to close (complete) the electric circuit and illuminate the LED lamp.

The illuminated LED lamp then may be used to help guide the clamp with lamp to the negative (anode) and/or positive (cathode) post(s) of the automobile (or other rechargeable) battery. The open jaw ends of the upper clip and lower clip are then disposed about the appropriate automobile (or other rechargeable) battery post and the handle ends of the upper clip and lower clip are released, causing the jaw ends of the upper clip and lower clip to close and engage the battery post. At the same time, the switch device in the lower clip spins back around the axis of the clamp and engages the contact switch, causing the contact switch to open the electric circuit and turn off the LED lamp.

The clamp with lamp of the present invention has many advantages over prior art devices, including:

1. It integrates the clamp, lamp and battery within one simple circuit, so it is small, elegant, portable and durable.
2. The clamp itself acts as the switch; therefore, the LED lamp goes on and off automatically as the jaws open and close. Thus, electricity is saved.
3. Such an indefinite factor as the transmogrification of materials cannot directly influence the use of the LED lamp.

These and other features and advantages of the present invention will be apparent from the following detailed description and drawings in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
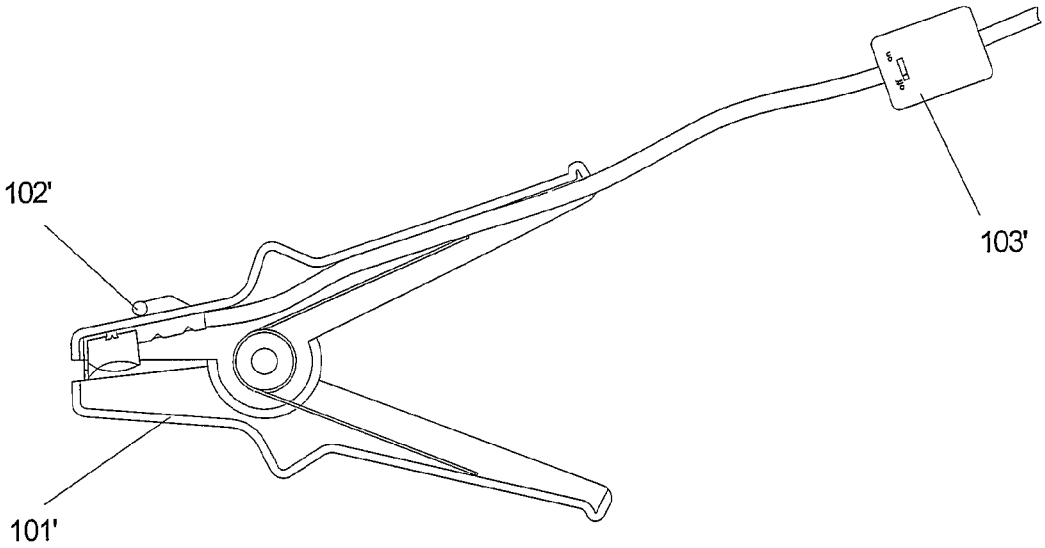
FIG. 1 is a partial cross-sectional side view of a prior art clamp with lamp.

While the present invention is susceptible of embodiment in various forms, there are shown in the drawings and will hereinafter be described several preferred embodiments with the understanding that the present disclosure is to be considered an exemplification of the invention and is not intended to limit the invention to the specific embodiments illustrated.

It should be further understood that the title of this section of the specification, namely, "Detailed Description of the Invention," relates to a requirement of the United States Patent and Trademark Office, and does not imply, nor should be inferred to limit the subject matter disclosed herein.

Figure 2:
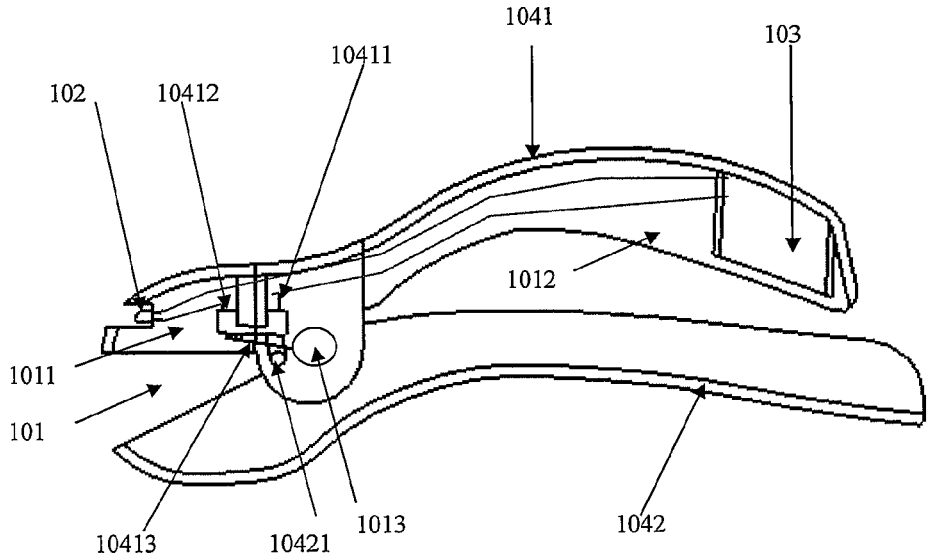
FIG. 2 is a partial cross-sectional side view of a clamp with lamp embodying the principles of the present invention, shown with the jaw ends of the upper clip and the lower clip in a open position and the LED lamp illuminated.
Figure 3:
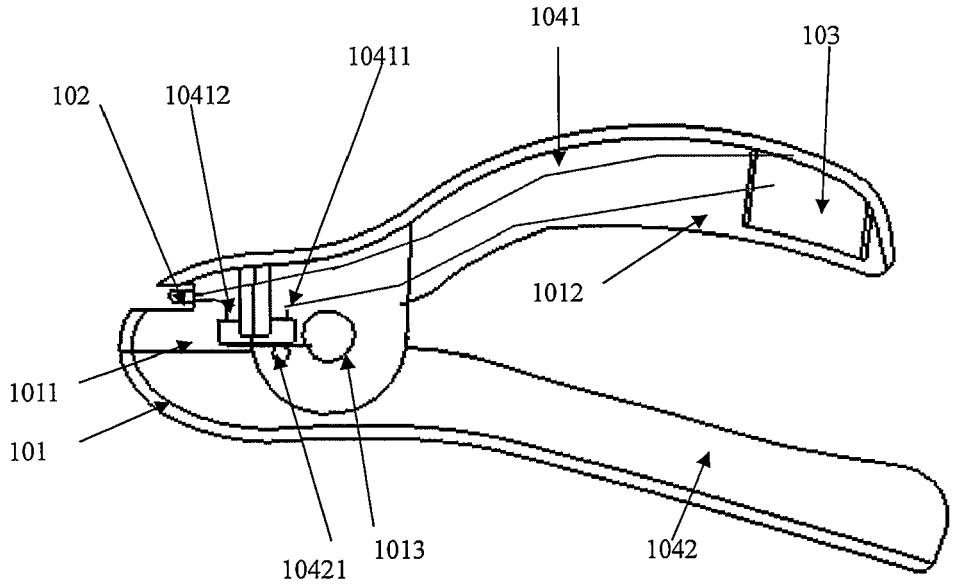
FIG. 3 is a partial cross-sectional side view of the clamp with lamp embodying the principles of the present invention as shown in FIG. 2, shown with the jaw ends of the upper clip and the lower clip in a closed position and the LED lamp not illuminated; and, FIG. 4 is a circuit diagram of the electric circuit of the clamp with lamp embodying the principles of the present invention.
Figure 4:
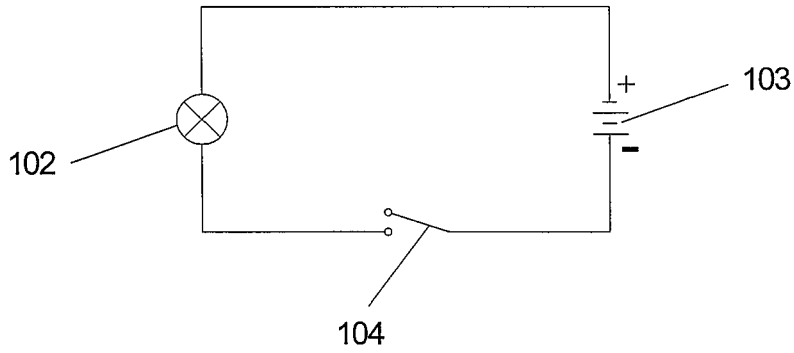

FIGS. 2, 3 and 4 illustrate the best mode of implementation of the preferred embodiment of the clamp with lamp of the present invention.

As shown in FIGS. 2, 3 and 4, the clamp with lamp 101 of the present invention comprises two body members (or clips), an upper clip 1041 and a lower clip 1042, each having a jaw end disposed at the front of clamp 101 (an upper jaw end 1011 and a lower jaw end) and a handle end disposed at the rear of clamp 101.

Upper clip 1041 and lower clip 1042 are pivotally engaged by an axis 1013. In some embodiments the jaw ends of upper clip 1041 and lower clip 1042 may be biased in a closed position (and the handle ends of upper clip 1041 and lower clip 1042 biased in a open position) using a spring (not shown) or other means as is known in the art.

An LED lamp 102 is disposed at the top of the upper jaw end (1011) of upper clip 1041 and a battery 103 is disposed inside the handle end of upper clip 1041. Battery 103 is connected with LED lamp 102 through an electric circuit controlled by a switching mechanism 104. The elements of the electric circuit, as further described below, may be connected with wires or other methods as known in the art.

Switching mechanism 104 is disposed at the axis 1013 (the juncture of upper clip 1041 and lower clip 1042) of the clamp 101 and comprises a contact switch disposed in upper clip 1041 and a switch device 10421 disposed in the lower clip 1042. The contact switch includes a lever 10413 operatively engaged therewith and extending downward toward lower clip 1042. Switching mechanism 104 further comprises a switch device 10421 set in lower clip 1042. Switch device 10421 is configured to operatively engage lever 10413 of the contact switch in order to activate and deactivate the contact switch.

In the disclosed embodiment of the clamp with lamp 101 of the present invention, the contact switch is connected in series between the negative (anode) side of battery 103 and the negative (anode) side of LED lamp 102. Specifically, the negative (anode) side of battery 103 is connected to a first terminal 10411 of the contact switch using a wire or other means as are known in the art. A second terminal 10412 of the contact switch is connected to the negative (anode) side of LED lamp 102, again using a wire or other means as is known in the art. Finally, the positive side of LED lamp 102 is connected with the positive (cathode) side of battery 103.

Thus, a simple switched electric circuit is formed to control the operation of LED lamp 102. Those skilled in the art will recognize that the contact switch also could be placed between the positive (cathode) side of battery 103 and the positive (cathode) side of LED lamp 102 without affecting the operation of the invention.

In one embodiment of the present invention, a lampshade, or LED cover, is disposed about LED lamp 102 to protect LED lamp 102 and to help direct and focus the light produced by LED lamp 102. Additionally, in one embodiment of the present invention, a battery cover, or access panel, is disposed in upper clip 1041 to provide access to the compartment in which battery 103 is disposed.

Clamp with lamp 101 of the present invention may be operated as follows. First, the handle ends of upper clip 1041 and the lower clip 1042 are pressed, or squeezed, together, causing upper clip 1041 and lower clip 1042 to pivot about axis 1013 and forcing the jaw ends of upper clip 1041 and lower clip 1042 open. As the upper jaw end 1011 of upper clip 1041 separates from the lower jaw end of lower clip 1042, switch device 10421 in lower clip 1042 rotates around axis 1013 of clamp 101, disengaging switch device from lever 10413 of the contact switch, and causing the contact switch to close (complete) the electric circuit and illuminate LED lamp 102.

The illuminated LED lamp 102 then may be used to help guide clamp with lamp 101 to the negative (anode) and/or positive (cathode) post(s) of the automobile (or other rechargeable) battery. The open jaw ends of the upper clip 1041 and lower clip 1042 are then disposed about the appropriate battery post of the automobile (or other rechargeable) battery and the handle ends of upper clip 1041 and lower clip 1042 are released, causing the jaw ends of upper clip 1041 and lower clip 1042 to close and engage the battery post of the automobile (or other rechargeable) battery. At the same time, switch device 10421 in lower clip 1042 spins back around axis 1013 of clamp 101 and engages lever 10413 of the contact switch, causing the contact switch to open the electric circuit and turn off LED lamp 102.

Clamp with lamp 101 of the present invention has many advantages over other clamps as are known in the art, including:

1. It integrates the clamp, lamp and battery within one simple circuit, so it is small, elegant, portable and durable.

2. The clamp itself acts as the switch; therefore, the LED lamp goes on and off automatically as the jaws open and close. Thus, electricity is saved.

3. Such an indefinite factor as the transmogrification of materials cannot directly influence the use of the LED lamp.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

In the present disclosure, the words "a" or "an" are to be taken to include both the singular and the plural. Conversely, any reference to plural items shall, where appropriate, include the singular.

All patents referred to herein, are hereby incorporated herein by reference, whether or not specifically done so within the text of this disclosure.

What is claimed is:

1. A clamp with lamp, the clamp comprising an upper clip and a lower clip, the upper clip and the lower clip operatively connected at an axis, and the upper clip and the lower clip each having a jaw end and a handle end;

an LED lamp;

a battery; and a switching mechanism disposed at the axis;

wherein the LED lamp, the battery and the switching mechanism are connected in an electric circuit, the LED lamp is disposed above the jaw end of the upper clip, and the battery is disposed inside the handle end of the upper clip; and wherein the switching mechanism comprises a contact switch disposed in the upper clip and connected in series with the electric circuit, the contact switch configured to switch the LED lamp on and off, and a switch device disposed in the lower clip, the switch device configured to engage the contact switch; and wherein when the jaw ends of the upper clip and the lower clip open and close, the switch device in the lower clip disengages and engages the contact switch, thereby switching the LED lamp on and off.

2. The clamp with lamp of claim 1 wherein the clamp further comprises a lampshade disposed about the LED lamp.

3. The clamp with lamp of claim 1 wherein the clamp further comprises a battery cover for the battery.

4. A clamp with lamp for attaching to a post of a rechargeable battery, the clamp comprising:

an upper clip and a lower clip, the upper clip and the lower clip operatively connected at an axis, and the upper clip and the lower clip each having a jaw end and a handle end;

an LED lamp;

a battery; and a switching mechanism disposed at the axis;

wherein the LED lamp, the battery and the switching mechanism are connected in an electric circuit, the LED lamp is disposed above the jaw end of the upper clip, and the battery is disposed inside the handle end of the upper clip; and wherein the switching mechanism comprises a contact switch disposed in the upper clip and connected in series with the electric circuit, the contact switch configured to switch the LED lamp on and off, and a switch device disposed in the lower clip, the switch device configured to engage the contact switch; and wherein when the handle ends of the upper clip and the lower clip are squeezed together, the jaw ends of the upper clip and the lower clip are forced open and the switch device in the lower clip rotates around the axis of the clamp, disengaging the switch device and the contact switch to close the electric circuit and to illuminate the LED lamp, and wherein when the jaw ends of the upper clip and the lower clip are disposed about the post of the rechargeable battery and the handle ends of the upper clip and the lower clip are released, the jaw ends of the upper clip and the lower clip engage the post, and the switch device in the lower clip spins back around the axis of the clamp and engages the contact switch to open the electric circuit and turn off the LED lamp.

5. The clamp with lamp of claim 4 wherein the clamp further comprises a lampshade disposed about the LED lamp.

6. The clamp with lamp of claim 4 wherein the clamp further comprises a battery cover for the battery.

7. A clamp with lamp, the clamp comprising:

an upper clip and a lower clip, the upper clip and the lower clip operatively connected at an axis;

an LED lamp;

a battery; and a switching mechanism installed at the axis, the switching mechanism configured to switch the LED lamp on and off;

wherein the LED lamp, the battery and the switching mechanism are connected in an electric circuit; and wherein the switching mechanism comprises a contact switch disposed in the upper clip, the contact switch configured to switch the LED lamp on and off, and a switch device disposed in the lower clip, the switch device configured to engage and disengage with the contact switch; and wherein when the upper clip and lower clip are squeezed together, the switch device in the lower clip rotates around the axis of the clamp, disengaging the switch device and the contact switch to close the electric circuit and to illuminate the LED lamp, and wherein when the upper clip and the lower clip are released, the switch device in the lower clip spins back around the axis of the clamp and engages the contact switch to open the electric circuit and turn off the LED lamp.

8. The clamp with lamp of claim 7 wherein the LED lamp is disposed on top of the upper clip.

9. The clamp with lamp of claim 8 wherein the clamp further comprises a lampshade disposed about the LED lamp.

10. The clamp with lamp of claim 7 wherein the battery is disposed inside the upper clip.

11. The clamp with lamp of claim 10 wherein the clamp further comprises a battery cover for the battery.

12. A clamp with lamp for attaching to a post of a rechargeable battery, the clamp comprising:

an upper clip and a lower clip, the upper clip and the lower clip operatively connected at an axis, and the upper clip and the lower clip each having a jaw end and a handle end;

an LED lamp, the LED lamp having a cathode side and an anode side;

a battery, the battery having a cathode side and an anode side; and a switching mechanism installed at the axis, the switching mechanism configured to switch the LED lamp on and off;

wherein the LED lamp, the battery and the switching mechanism are connected in an electric circuit;

wherein the switching mechanism comprises a contact switch disposed in the upper clip, the contact switch disposed between the anode side of the battery and the anode side of the LED lamp and configured to switch the LED lamp on and off, and a switch device disposed in the lower clip, the switch device configured to engage and disengage with the contact switch;

wherein the cathode side of the LED lamp is connected to the cathode side of the battery; and wherein when the handle ends of the upper clip and the lower clip are squeezed together, the jaw ends of the upper clip and the lower clip are forced open and the switch device in the lower clip rotates around the axis of the clamp, disengaging the switch device and the contact switch to close the electric circuit and to illuminate the LED lamp, and wherein when the jaw ends of the upper clip and the lower clip are disposed about the post of the rechargeable battery and the handle ends of the upper clip and the lower clip are released, the jaw ends of the upper clip and the lower clip engage the post, and the switch device in the lower clip spins back around the axis of the clamp and engages the contact switch to open the electric circuit and turn off the LED lamp.

13. The clamp with lamp of claim 12 wherein the LED lamp is disposed on the top of the jaw end of the upper clip.

14. The clamp with lamp of claim 13 wherein the clamp further comprises a lampshade disposed about the LED lamp.

15. The clamp with lamp of claim 12 wherein the battery is disposed inside the handle end of the upper clip.

16. The clamp with lamp of claim 15 wherein the clamp further comprises a battery cover for the battery.

* * * * *